US011672299B2

(12) United States Patent
Lee

(10) Patent No.: US 11,672,299 B2
(45) Date of Patent: Jun. 13, 2023

(54) HELMET INCLUDING MOUTH VENTS

(71) Applicant: HJC CORP., Gyeonggi-do (KR)

(72) Inventor: Yun-Haeng Lee, Gyeonggi-do (KR)

(73) Assignee: HJC CORP., Gyeonggi-do (KR)

( * ) Notice: Subject to any disclaimer, the term of this patent is extended or adjusted under 35 U.S.C. 154(b) by 189 days.

(21) Appl. No.: 17/270,716

(22) PCT Filed: Jun. 11, 2019

(86) PCT No.: PCT/KR2019/006969
§ 371 (c)(1),
(2) Date: Feb. 23, 2021

(87) PCT Pub. No.: WO2020/045801
PCT Pub. Date: Mar. 5, 2020

(65) Prior Publication Data

US 2021/0345722 A1 Nov. 11, 2021

(30) Foreign Application Priority Data

Aug. 31, 2018 (KR) ..... 10-2018-0103461

(51) Int. Cl.
*A42B 3/28* (2006.01)
*A42B 3/20* (2006.01)

(52) U.S. Cl.
CPC ..... *A42B 3/283* (2013.01); *A42B 3/205* (2013.01)

(58) Field of Classification Search
CPC ..... A42B 3/283; A42B 3/28; A42B 3/205
USPC ..... 2/424
See application file for complete search history.

(56) References Cited

U.S. PATENT DOCUMENTS 2,511,234 A * 6/1950 Anderson ..... A42B 3/145 403/107
4,498,202 A * 2/1985 Yamamoto ..... A42B 3/24 2/424
5,031,237 A * 7/1991 Honrud ..... A61F 9/068 128/201.25

FOREIGN PATENT DOCUMENTS

| | | |
|---|---|---|
| JP | 05-85823 | 11/1993 |
| JP | 2005-325461 | 11/2005 |
| KR | 1992-0010987 | 12/1992 |
| KR | 10-0317817 | 12/2001 |
| KR | 10-0394293 | 7/2003 |
| KR | 10-1253491 | 4/2013 |

* cited by examiner

*Primary Examiner* — Timothy K Trieu
(74) *Attorney, Agent, or Firm* — Duane Morris LLP; Gregory M. Lefkowitz

(57) ABSTRACT

The present invention relates to a helmet including mouth vents. The helmet of the present invention includes: a chin guard 100 having a first fastening portion 110 and a second fastening portion 120; a vent body 200 having a first fastening protrusion 210 protruding toward the chin guard 100 so as to be inserted into and fixed to the first fastening portion 110 and a second fastening protrusion 220 protruding toward the chin guard 100 so as to be inserted into and penetrate the second fastening portion 120; and fixing means 300 detachably coupled with the second fastening protrusion 220 penetrating the second fastening portion 120 to fix the second fastening protrusion 220 to the second fastening portion 120.

15 Claims, 8 Drawing Sheets

HELMET INCLUDING MOUTH VENTS

CROSS-REFERENCE TO RELATED APPLICATIONS

This application is a §371 national stage entry of International Application No. PCT/KR2019/006969, filed on Jun. 11, 2019, which claims priority to Korean Patent Application No. 10-2018-0103461, filed on Aug. 31, 2018, the entire contents of which are incorporated herein by reference.

TECHNICAL FIELD

The present invention relates to a helmet including mouth vents.

BACKGROUND ART

In general, a rider of a two-wheeled vehicle is required to wear a helmet in order to protect his/her head when riding at high speed.

Such a helmet includes a helmet body forming its outer shape, a liner fixed to the inner surface of the helmet body, and a pad mounted in the liner to improve its wearing stability and comfortability. The helmet body should be strong enough to withstand damage caused by external impacts to protect the wearer's head. The liner and the pad should absorb and dampen impacts applied to the helmet body to ensure the wearer's safety.

Patent Document 1 discloses a helmet having air inlets, commonly called vents, in communication with external air. The vents may be formed at various locations of a helmet body. For example, the vents may be formed in a chin guard of the helmet body. Such vents are generally referred to as mouth vents. Foreign materials such as mud and dust tend to accumulate in the mouth vents arranged in the front portion of the helmet body during riding. Thus, foreign materials need to be removed by washing the mouth vents after riding. Particularly, foreign materials should be removed from the mouth vents for the wearer's health because external air enters the wearer's respiratory tract through the mouth vents.

However, the mouth vents completely fixed to the chin guard of the prior art helmet are impossible or very complicated to separate from the chin guard, making it difficult to remove foreign materials from the mouth vents.

PRIOR ART DOCUMENTS

Patent Documents (Patent Document 1) KR10-0317817 B1

DETAILED DESCRIPTION OF THE INVENTION

Problems to be Solved by the Invention

The present invention has been made in an effort to solve the problems of the prior art and one aspect of the present invention is to provide a helmet including mouth vents in which a vent body can be easily fixed to or separated from a chin guard using fixing means.

Means for Solving the Problems

A helmet including mouth vents according to one embodiment of the present invention includes: a chin guard having a first fastening portion and a second fastening portion; a vent body having a first fastening protrusion protruding toward the chin guard so as to be inserted into and fixed to the first fastening portion and a second fastening protrusion protruding toward the chin guard so as to be inserted into and penetrate the second fastening portion; and fixing means detachably coupled with the second fastening protrusion penetrating the second fastening portion to fix the second fastening protrusion to the second fastening portion.

In the helmet, the first fastening portion is an upwardly open fastening recess penetrating into a wall having a predetermined thickness along the thickness direction and having a predetermined area, the first fastening protrusion is introduced into the open upper side of the fastening recess, and latching means is disposed with a larger area than the predetermined area at one end of the first fastening protrusion and is latched to the fastening recess.

In the helmet, the latching means is a washer coupled with the first fastening protrusion.

In the helmet, the second fastening portion is a fastening hole penetrating the chin guard; the second fastening protrusion is inserted into the fastening hole; and when the fixing means is coupled with the second fastening protrusion inserted into the fastening hole, at least a portion of the fixing means is latched to the fastening hole such that the second fastening protrusion is fixed to the second fastening portion.

In the helmet, the fixing means includes a fixing body inserted into the fastening hole and an extension extending from the fixing body in a direction away from the center of the cross section of the fixing body and latched to the fastening hole.

In the helmet, the second fastening protrusion includes a fastening body extending from the vent body so as to be inserted into the fastening hole and a first fixing projection protruding in one direction from the fastening body; the fixing means includes a tubular fixing body into which the fastening body is insertable and a second fixing projection protruding in the other direction from the fixing body; and when the fixing body rotates after insertion of the fastening body into the fixing body, one surface of the first fixing projection comes into contact with one surface of the second fixing projection such that the fixing means is coupled with the second fastening protrusion.

In the helmet, the first fixing projection is provided in plurality and the first fixing projections are spaced apart from each other; the second fixing projection is provided in plurality and the second fixing projections are spaced apart from each other; and when the fastening body is inserted into the fixing body, each of the first fixing projections passes between the adjacent second fixing projections spaced apart from each other and each of the second fixing projections passes between the adjacent first fixing projections spaced apart from each other.

In the helmet, wherein the fixing body is configured to rotates after insertion of the fastening body thereinto, leading one side of the first fixing projection to come into contact with one side of the second fixing projection and one surface of the first fixing projection to come into contact with one surface of the second fixing projection, wherein an inclined face is formed on at least one of the one side of the first fixing projection and the one side of the second fixing projection.

In the helmet, a first stepped portion protruding toward one surface of the second fixing projection is formed on one surface of the first fixing projection and a second stepped portion protruding toward one surface of the first fixing projection is formed on one surface of the second fixing projection.

In the helmet, when the fixing body rotates after insertion of the fastening body into the fixing body, one side of the first fixing projection comes into contact with one side of the second fixing projection and, thereafter, one surface of the first fixing projection comes into contact with one surface of the second fixing projection; and a stopper is formed at the other side of the second fixing projection to latch one side of the first fixing body.

In the helmet, the fastening body has an empty space formed at the center thereof, and the fixing means further includes a guide projection formed at the center of the tubular fixing body, extending in a direction corresponding to the lengthwise direction of the fixing body, and inserted into the central empty space of the fastening body.

In the helmet, a manipulation portion is formed at one end of the fixing body farther away from the vent body and is manipulated to rotate the fixing body by a wearer.

In the helmet, the vent body further includes at least one guide protrusion protruding toward the chin guard; a guide depression depressed corresponding to the guide protrusion is formed in the chin guard; and when the second fastening protrusion is inserted into the second fastening portion, the guide protrusion guides the second fastening protrusion toward the second fastening portion while moving in contact with the guide depression.

In the helmet, the guide protrusion is provided in two and the second fastening protrusion is flanked by the two guide protrusions; and the guide depression is provided in two and the second fastening portion is flanked by the two guide depressions.

In the helmet, a first vent portion through which air communicates is formed in the guide protrusion and a second vent portion through which air communicates is formed in the guide depression.

In the helmet, a third vent portion through which air communicates is formed between the first fastening portion and the second fastening portion of the chin guard and a fourth vent portion through which air communicates is formed between the first fastening protrusion and the second fastening protrusion of the vent body.

The features and advantages of the present invention will become more apparent from the detailed description set forth below with reference to the appended drawings.

Prior to the detailed description of the invention, it should be understood that the terms and words used in the specification and claims are not to be construed as having common and dictionary meanings, but are construed as having meanings and concepts corresponding to the spirit of the invention in view of the principle that the inventor can define properly the concept of the terms and words in order to describe his/her invention with the best method.

Effects of the Invention

The helmet of the present invention is constructed such that the vent body can be easily fixed to or separated from the chin guard using the fixing means. Due to this construction, foreign materials can be removed from the vent body or the chin guard.

BEST MODE FOR CARRYING OUT THE INVENTION

Figure 1:
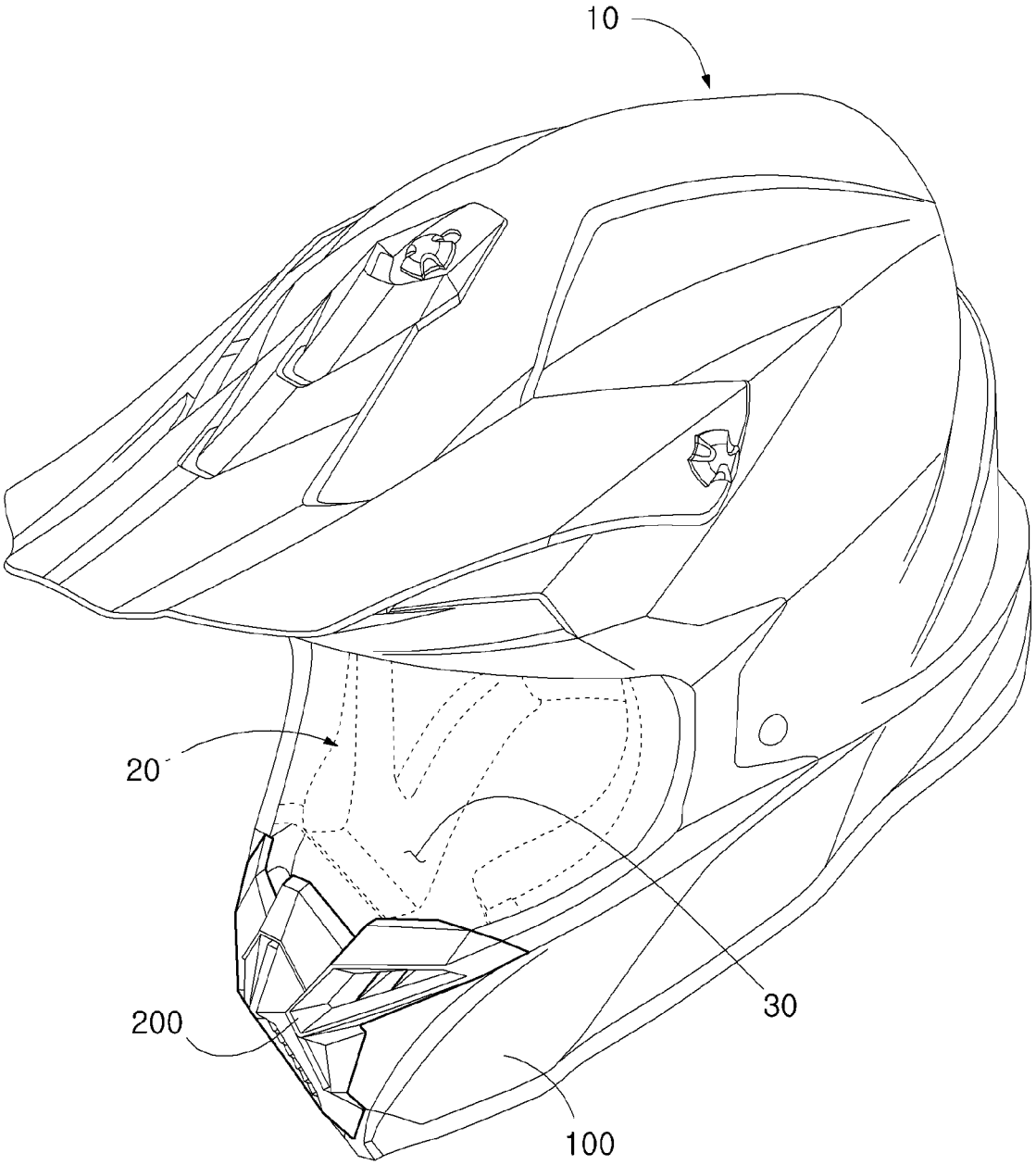
FIG. 1 is a perspective view of a helmet including mouth vents according to one embodiment of the present invention.

The objects, certain advantages, and novel features of the present invention will become more apparent from the following detailed description and preferred embodiments when taken in conjunction with the accompanying drawings. It should be noted that, wherever possible, the same elements are denoted by the same reference numerals even though they are depicted in different drawings. Although the terms "first", "second", etc. may be used herein to describe various elements, these elements should not be limited by these terms. These terms are only used to distinguish one element from another. In the description of the present invention, certain detailed explanations of related art are omitted when it is deemed that they may unnecessarily obscure the essence of the invention.

Preferred embodiments of the present invention will now be described in detail with reference to the accompanying drawings.

Figure 2:
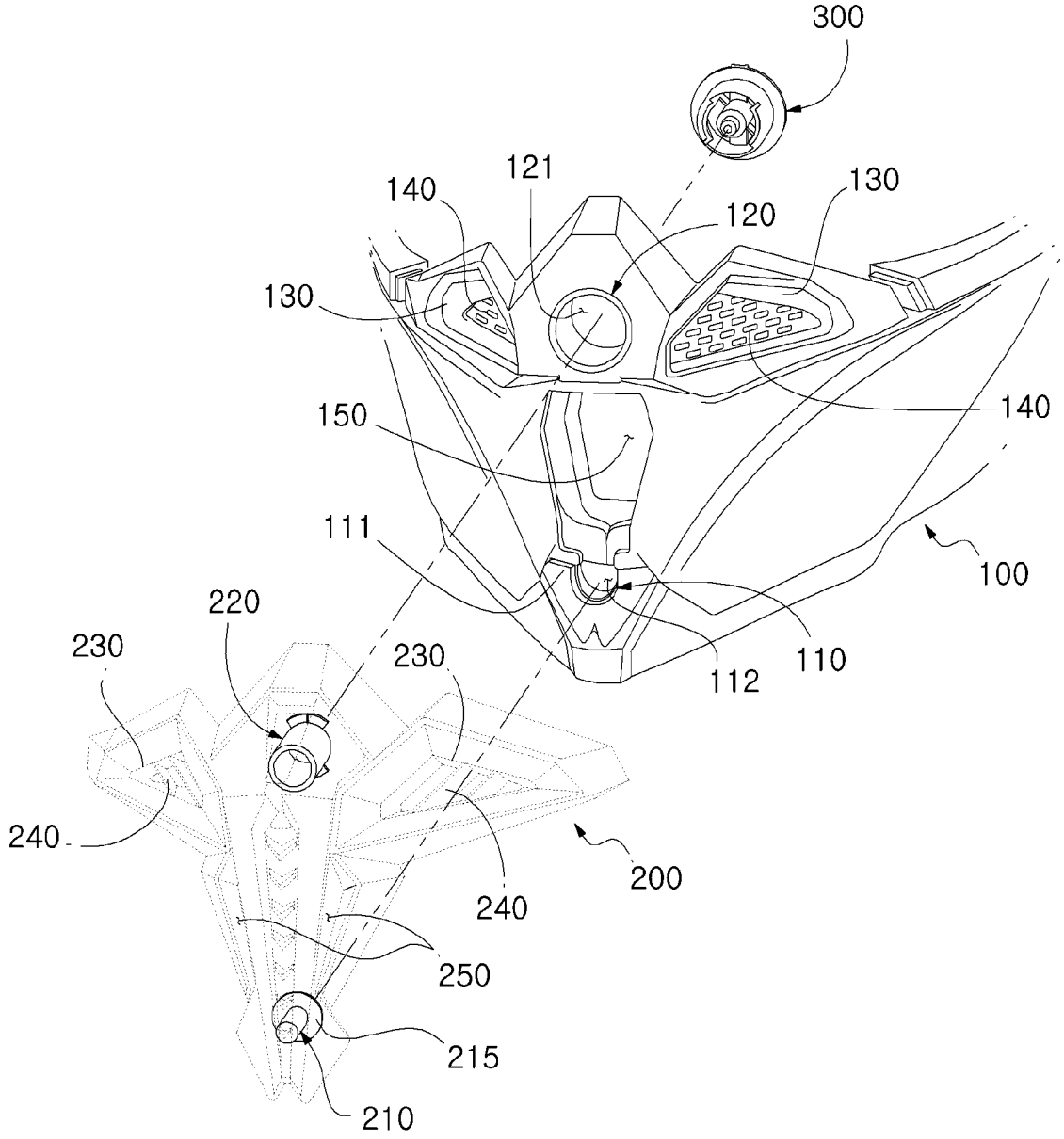
FIGS. 2 and 3 are enlarged perspective views of a vent body and a chin guard of a helmet including mouth vents according to one embodiment of the present invention.
Figure 3:
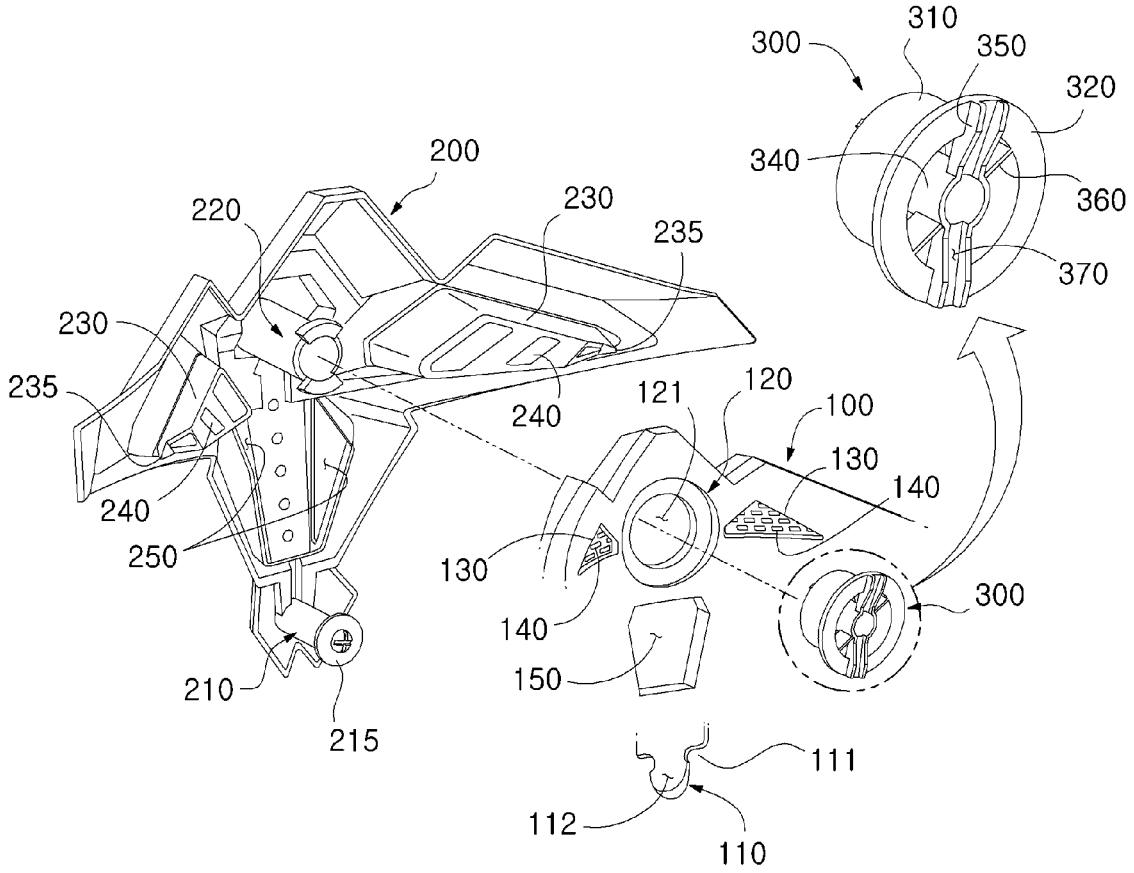

FIG. 1 is a perspective view of a helmet including mouth vents according to one embodiment of the present invention and FIGS. 2 and 3 are enlarged perspective views of a vent body and a chin guard of the helmet.

As illustrated in FIGS. 2 and 3, the helmet includes: a chin guard 100 having a first fastening portion 110 and a second fastening portion 120; a vent body 200 having a first fastening protrusion 210 protruding toward the chin guard 100 so as to be inserted into and fixed to the first fastening portion 110 and a second fastening protrusion 220 protruding toward the chin guard 100 so as to be inserted into and penetrate the second fastening portion 120; and fixing means 300 detachably coupled with the second fastening protrusion 220 penetrating the second fastening portion 120 to fix the second fastening protrusion 220 to the second fastening portion 120.

As illustrated in FIG. 1, the helmet essentially includes a helmet body 10, a pad 20, etc. The helmet body 10 can be made of an impact-absorbing material. For example, the helmet body 10 may include an outer shell with high strength made of a hard synthetic resin and an absorber with appropriate strength and elasticity provided inside the outer shell and made of expanded polystyrene (EPS). The pad 20 is provided inside the helmet body 10 to ensure improved wearing stability.

The helmet body 10 may have a front opening 30 through which a sufficient field of view can be secured for a wearer. An openable and closable shield may be provided in the opening 30 to optionally shield wind, dirt, etc. but may be omitted for an off-road application (see FIG. 1). A chin guard 100 can be provided at the lower end of the opening 30 of the helmet body 10 and a vent body 200 can be detachably coupled to the chin guard 100, which will be specifically described below.

MODE FOR CARRYING OUT THE INVENTION

First, the chin guard 100 serves to protect the wearer's chin and extends forward from both lower ends of the helmet body 10. As illustrated in FIGS. 2 to 3, vent portions (second and third vent portions 140 and 150) are formed in the chin guard 100 and the vent body 200 is detachably coupled to the chin guard 100 to cover the vent portions (second and third vent portions 140 and 150). For this coupling, a first fastening portion 110 and a second fastening portion 120 are formed in the chin guard 100. Here, the first fastening portion 110 and the second fastening portion 120 are arranged vertically. The first fastening portion 110 is arranged below the second fastening portion 120 and the second fastening portion 120 is arranged above the first fastening portion 110.

Specifically, the first fastening portion 110 is an upwardly open fastening recess 112 that penetrates into a wall 111 having a predetermined thickness along the thickness direction and has a predetermined area. Here, the fastening recess 112 is formed by downwardly depressing a wall 111 having a predetermined thickness provided at the front end of the chin guard 100 to have a substantially circular cross-sectional shape. The fastening recess 112 has an upper side whose width is smaller than the central width.

The second fastening portion 120 is a fastening hole 121 that penetrates the chin guard in the thickness direction. Here, the fastening hole 121 is cylindrical in shape and passes through the chin guard 100.

A first fastening protrusion 210 and a second fastening protrusion 220 of the vent body 200 are inserted into the fastening recess 112 and the fastening hole 121, respectively, which will be described below.

Next, the vent body 200 serves to cover the vent portions (second and third vent portions 140 and 150) of the chin guard 100 and may be made of any suitable material, for example, a plastic material. Vent portions (first and fourth vent portions 240 and 250) corresponding to the vent portions (second and third vent portions 140 and 150) of the chin guard 100 may be formed in the vent body 200. External air can flow into the helmet body 10 through the vent portions (first and fourth vent portions 240 and 250) of the vent body 200 and the vent portions (second and third vent portions 140 and 150) of the chin guard 100 in this order.

As described above, the vent body 200 can be detachably coupled to the chin guard 100. For this coupling, a first fastening protrusion 210 and a second fastening protrusion 220 are formed in the vent body 200. Here, the first fastening protrusion 210 and the second fastening protrusion 220 are arranged vertically. The first fastening protrusion 210 is arranged below the second fastening protrusion 220 and the second fastening protrusion 220 is arranged above the first fastening protrusion 210.

Specifically, since the first fastening protrusion 210 is introduced into the open upper side of the fastening recess 112 and the fastening recess 112 has a circular cross-sectional shape, the first fastening protrusion 210 is also made cylindrical in shape corresponding to the shape of the fastening recess 112. The first fastening protrusion 210 introduced into the upper side of the fastening recess 112 and inserted into the fastening recess 112 can be prevented from being undesirably separated from the fastening recess 112 because the upper side of the fastening recess 112 has a width smaller than the central width. Latching means 215 is disposed at one end of the first fastening protrusion 210. The latching means 215 has a larger area than the predetermined area of the fastening recess 112. With these dimensions, the latching means 215 is latched to the inside of the fastening recess 112 so that the first fastening protrusion 210 can be prevented from being separated in a direction away from the chin guard 100. The latching means 215 is not particularly limited but may be, for example, a washer coupled to one end of the first fastening protrusion 210 by screws.

Since the second fastening protrusion 220 is inserted into the cylindrical fastening hole 121 penetrating the chin guard 100, the second fastening protrusion 220 is also made cylindrical in shape corresponding to the shape of the fastening hole 121. Fixing means 300 is coupled with one end of the second fastening protrusion 220 inserted into the fastening hole 121. When the fixing means 300 is coupled with one end of the second fastening protrusion 220, at least a portion of the fixing means 300 is latched to the inside of the fastening hole 121 so that the second fastening protrusion 220 can be fixed to the second fastening portion 120. Details of the coupling between the second fastening protrusion 220 and the fixing means 300 will be described below.

Figure 7:
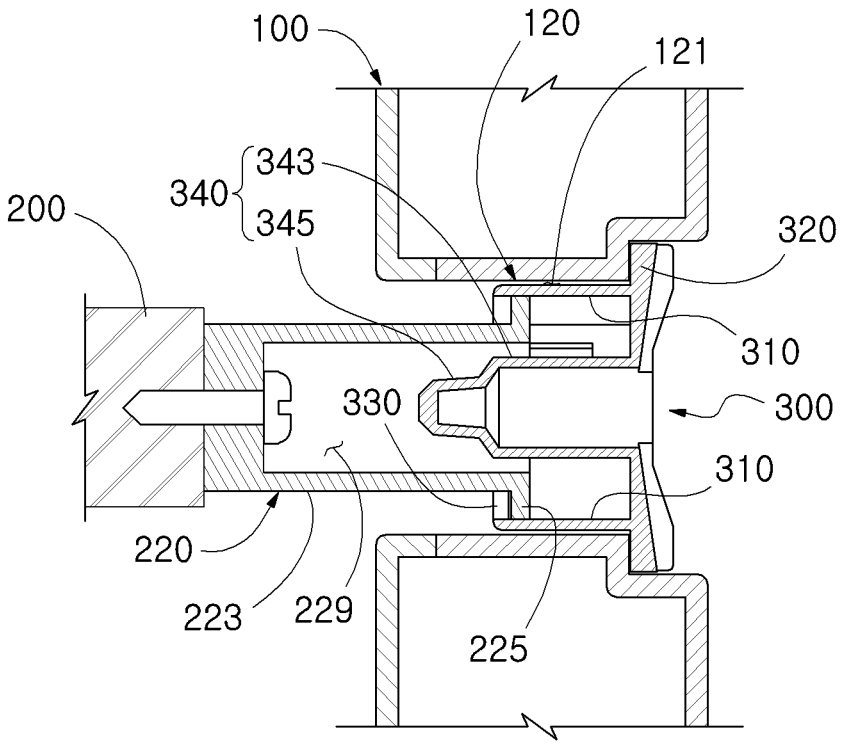
FIGS. 7 and 8 are cross-sectional views of the second fastening protrusion and the fixing means illustrated in FIG. 4.
Figure 8:
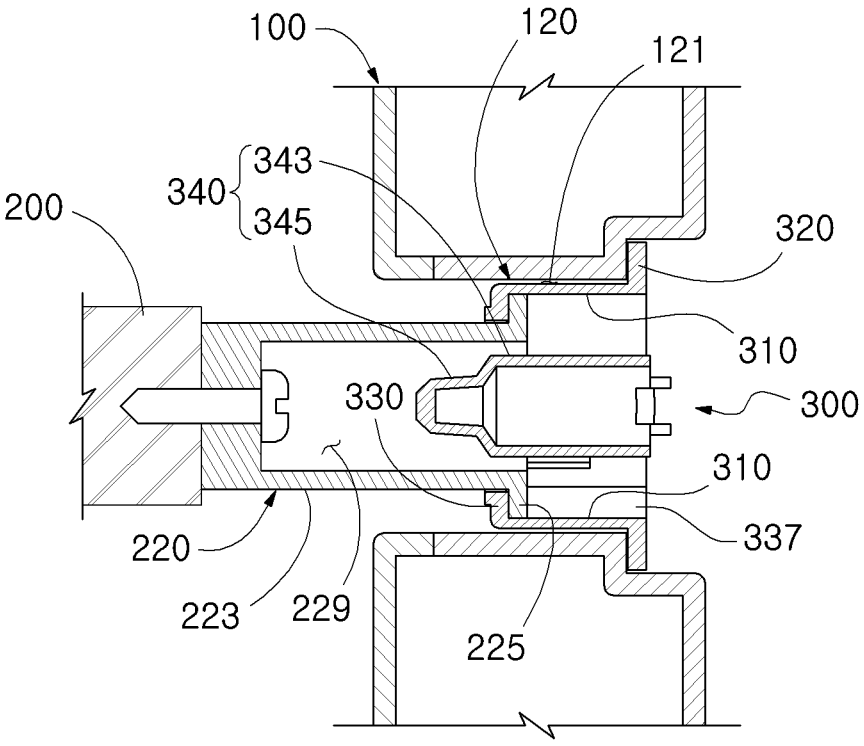

Next, the fixing means 300 serves to fix the second fastening protrusion 220 to the second fastening portion 120. The fixing means 300 is detachably coupled with the second fastening protrusion 220 penetrating the second fastening portion 120. The fixing means 300 includes a fixing body 310 and an extension 320 (see the enlarged view in FIG. 3 and FIG. 4). Specifically, the fixing body 310 can be inserted into the fastening hole 121 due to its tubular shape and smaller cross-sectional area than the fastening hole 121, as illustrated in FIGS. 7 to 8. The extension 320 extends from one end of the fixing body 310 in a direction away (in a radial direction) from the center of the cross section of the fixing body 310 and has a larger cross-sectional area than the fastening hole 121. Thus, when the fixing means 300 is coupled with one end of the second fastening protrusion 220, the extension 320 can be latched to the inside of the fastening hole 121, and as a result, the second fastening protrusion 220 can be fixed to the second fastening portion 120.

Figure 4:
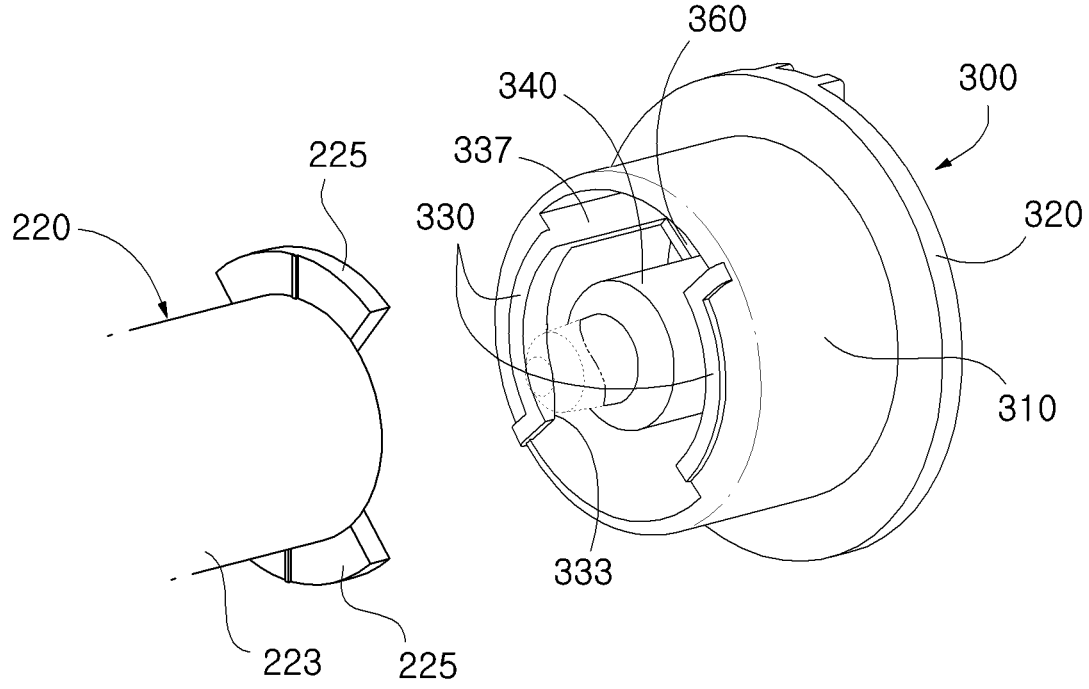
FIG. 4 illustrates perspective views of the second fastening protrusion and the fixing means illustrated in FIGS. 2 and 3.

Meanwhile, the second fastening protrusion 220 can be detachably coupled to the fixing means 300 by at least one first fixing projection 225 and at least one second fixing projection 330 (see FIG. 4). Specifically, the second fastening protrusion 220 includes a fastening body 223 and at least one first fixing projection 225. The fastening body 223 extends in a cylindrical shape from the vent body 200. Due to this shape, the fastening body 223 is inserted into the fastening hole 121. The first fixing projection 225 protrudes in one direction (in a direction away from the center of the cross section of the fastening body 223) from one end of the fastening body 223.

The fixing means 300 further includes a second fixing projection 330. The fastening body 223 is inserted into the tubular fixing body 310. The second fixing projection 330 protrudes in the other direction (in the direction toward the center of the cross section of the fixing body 310, i.e. in the direction opposite to the direction in which the first fixing projection 225 protrudes) from the other end of the fixing body 310 (the end opposite to the one end of the fixing body 310 at which the extension 320 is formed). Thus, when the fixing body 310 rotates (see FIGS. 6 and 7) after insertion of the fastening body 223 into the fixing body 310 (see FIGS. 5 and 7), the first fixing projection 225 and the second fixing projection 330 can face each other. In this way, the fixing means 300 can be coupled with the second fastening protrusion 220 when one surface of the first fixing projection 225 and one surface of the second fixing projection 330 facing each other are in contact with each other. Here, a force is applied to the fixing body 310 in a direction away from the vent body 200 by the extension 320 latched to the inside of the fastening hole 121, and as a result, a frictional force acts between one surface of the first fixing projection 225 and one surface of the fixing projection 330. The frictional force prevents the fixing body 310 from arbitrarily rotating so that the fixing means 300 can be prevented from being undesirably separated from the second fastening protrusion 220.

More specifically, the first fixing projection 225 is provided in plurality and the first fixing projections 225 are spaced apart from each other; the second fixing projection 330 is provided in plurality and the second fixing projections 330 are spaced apart from each other, as illustrated in FIG. 4. For example, the first fixing projection 225 may be provided in two. In this case, the first fixing projections 225 are arranged to face each other. For example, the second fixing projection 330 may be provided in two. In this case, the second fixing projections 330 are arranged to face each other. The first fixing projections 225 and the second fixing projections 330 should not interfere with each other when the fastening body 223 is inserted into the fixing body 310. To this end, the first fixing projections 225 and the second fixing projections 330 are arranged such that each of the first fixing projections 225 passes between the two or more (for example, two) second fixing projections 330 spaced apart from each other and each of the second fixing projections 330 passes between the two or more (for example, two) first fixing projections 225 spaced apart from each other. That is, when the fastening body 223 is inserted into the fixing body 310, each of the first fixing projections 225 passes between the adjacent second fixing projections 330 and one of the second fixing projections 330 passes through the adjacent first fixing projections 225, with the result that the second fixing projections 330 can be closer to the vent body 200 than the first fixing projections 225 (see FIG. 7). Subsequent rotation of the fixing body 310 (see FIG. 8) causes one surface of the first fixing projection 225 to face one surface of the second fixing projection 330.

When the fixing body 310 rotates after insertion of the fastening body 223 into the fixing body 310, one side of the first fixing projection 225 comes into contact with one side of the second fixing projection 330 and, thereafter, one surface of the first fixing projection 225 faces and comes into contact with one surface of the second fixing projection 330. That is, one side (end) of the first fixing projection 225 comes into contact with one side (end) of the second fixing projection 330 before one surface of the first fixing projection 225 faces and comes into contact with one surface of the second fixing projection 330. If the first fixing projection 225 at least partially overlaps the second fixing projection 330 by insufficient insertion of the fastening body 223 into the fixing body 310, the fixing body 310 may be difficult to rotate. This difficulty can be overcome by the formation of an inclined face 333 (see FIGS. 4 to 5) at at least one of the one side of the first fixing projection 225 and the one side of the second fixing projection 330. For example, an inclined face 333 may be formed at one side of the second fixing projection 330. In this case, when the fixing body 310 rotates in a state in which one side of the first fixing projection 225 is in contact with one side of the second fixing projection 330, the one side of the first fixing projection 225 slides along the inclined face 333 of the second fixing projection 330, ensuring smooth rotation of the fixing body 310. The inclined face 333 of the second fixing projection 330 may form an obtuse angle with the one surface of the second fixing projection 330.

Figure 5:
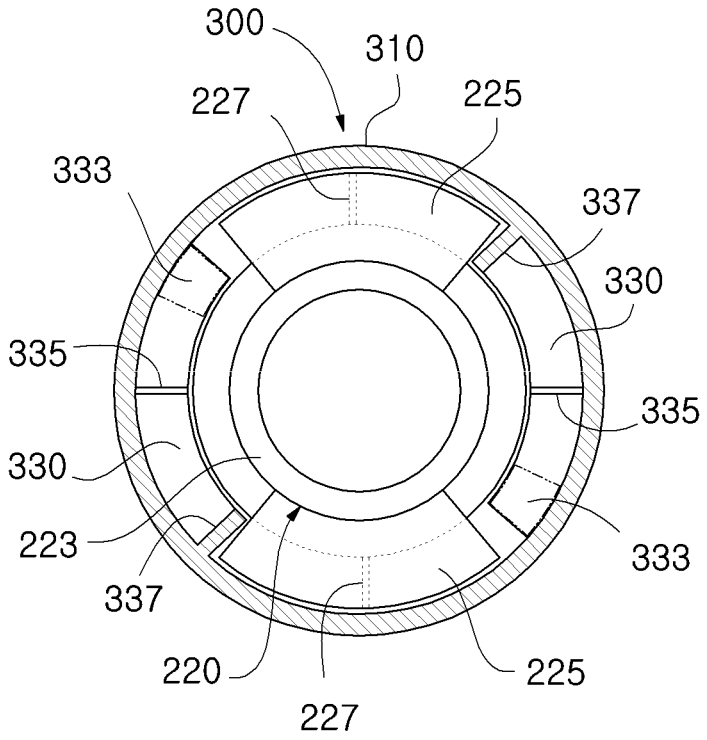
FIGS. 5 and 6 are plan views of the second fastening protrusion and the fixing means illustrated in FIG. 4 (excluding the guide protrusion and the first and second connection portions).
Figure 6:
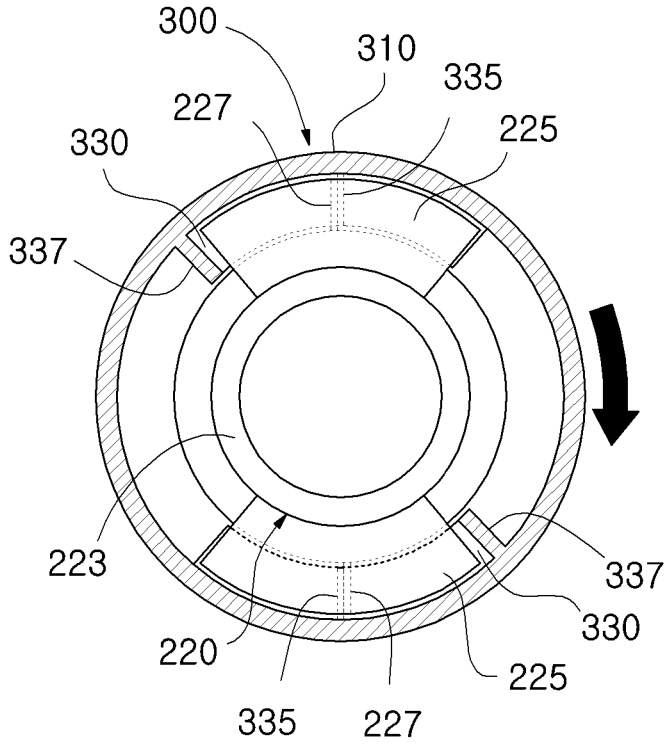

As described above, a frictional force acts between one surface of the first fixing projection 225 and one surface of the fixing projection 330 to prevent the fixing body 310 from arbitrarily rotating. To more reliably prevent the fixing body 310 from arbitrarily rotating, first and second stepped portions 227 and 335 may be formed on the first and second fixing projections 225 and 330, respectively (FIGS. 5 to 6). Specifically, the first stepped portion 227 formed on one surface of the first fixing projection 225 protrudes toward one surface of the second fixing projection 330 facing the one surface of the first fixing projection 225 and the second stepped portion 335 formed on one surface of the second fixing projection 330 protrudes toward one surface of the first fixing projection 225 facing the one surface of the second fixing projection 330. The first stepped portion 227 and the second stepped portion 335 are formed in a straight line extending perpendicular to the rotational direction of the fixing body 310. When the wearer rotates the fixing body 310, the first stepped portion 227 on one surface of the first fixing projection 225 overlaps the second stepped portion 335 formed on one surface of the second fixing projection 330 to block the second stepped portion 335 from going beyond the first stepped portion 227, with the result that the fixing body 310 can be completely prevented from arbitrarily rotating.

A stopper 337 is further formed on the second fixing projection 330 to prevent the fixing body 310 from continuing to rotate unnecessarily even after the fixing means 300 is completely coupled with the second fastening protrusion 220 in a state in which one surface of the first fixing projection 225 and one surface of the second fixing projection 330 are in contact with each other (see FIGS. 4 to 6). Specifically, the stopper 337 is formed at the other side of the second fixing projection 330 (the side opposite to the one side of the second fixing projection 330 at which the inclined face 333 is formed) and can latch one side of the first fixing projection 225. More specifically, the stopper 337 extends from the other side of the second fixing projection 330 along the inner wall of the tubular fixing body 310 in a direction away from the vent body 200, as illustrated in FIG. 8. When the fixing body 310 rotates in a state in which the fastening body 223 is inserted into the fixing body 310, one surface of the first fixing projection 225 and one surface of the second fixing projection 330 come into contact with each other and finally one side of the first fixing projection 225 is latched by the stopper 337 formed on the other side of the second fixing projection 330. That is, the stopper 337 can prevent the fixing body 310 from rotating further. In addition, when the wearer rotates the fixing body 310, the stopper 337 can actually provide feedback to the wearer that the first fixing projection 225 and the second fixing projection 330 are in maximum contact with each other.

As illustrated in FIGS. 7 to 8, the fastening body 223 has a tubular shape with a central empty space 229 and the fixing means 300 includes a guide projection 340 inserted into the central empty space 229 of the fastening body 223.

Specifically, the guide projection 340 is formed at the center of the tubular fixing body 310 and extends in a direction corresponding to the lengthwise direction of the fixing body 310. The guide projection 340 includes a first projection portion 343 arranged inside the fixing body 310 and a second projection portion 345 extending from the first projection portion 343 to the outside of the fixing body 310. The second projection portion 345 may have a smaller cross-sectional area than the first projection portion 343. With these dimensions, when the fixing means 300 is coupled with the second fastening protrusion 220, the second projection portion 345 can be relatively easily inserted into the central empty space 229 of the fastening body 223 and, thereafter, the first projection portion 343 can be naturally inserted into the central empty space 229 of the fastening body 223. The insertion of the first and second projection portions 343 and 345 into the central empty space 229 of the fastening body 223 enables the fixing means 300 to be appropriately guided to the second fastening protrusion 220.

As illustrated in the enlarged view in FIG. 3, the guide projection 340 is connected to the fixing body 310 through a first connection portion 350 traversing the fixing body 310 at one end of the fixing body 310 where the extension 320 is formed. The guide projection 340 is also connected to the fixing body 310 through a second connection portion 350 extending from the stopper 337.

A manipulation portion 370 is formed at one end of the fixing body 310 (the end of the fixing body 310 at which the extension 320 is formed) farther away from the vent body 200. The wearer can manipulate the manipulation portion 370 to rotate the fixing body 310. Specifically, the manipulation portion 370 extends in a predetermined direction from one end of the fixing body 310 and is formed in the shape of a groove. For example, the manipulation portion 370 may be formed in the shape of a groove extending in a straight line in the first connection portion 350 traversing the fixing body 310. Thus, the wearer can easily rotate the fixing body 310 by inserting a coin or flat-head screwdriver into the manipulation portion 370. However, the manipulation portion 370 is not necessarily limited to a groove shape and may have any shape (e.g., a protrusion shape) as long as the wearer can easily rotate the fixing body 310.

The vent body 200 includes at least one guide protrusion 230 protruding toward the chin guard 100 (see FIG. 3). A guide depression 130 depressed corresponding to the guide protrusion 230 is formed in the chin guard 100 (see FIG. 2). Thus, when the second fastening protrusion 220 is inserted into the second fastening portion 120 after insertion of the first fastening protrusion 210 into the first fastening portion 110, the guide protrusion 230 can guide the second fastening protrusion 220 toward the second fastening portion 120 while moving in contact with the guide depression 130. An outwardly protruding end projection 235 (see FIG. 3) is formed at one end of the guide protrusion 230. When the guide protrusion 230 is completely inserted into the guide depression 130, the end projection 235 are latched to the inside of the guide depression 130. The guide protrusion 230 inserted into the guide depression 130 can be fixed to the guide depression 130 by the end projection 235. More specifically, the guide protrusion 230 is provided in two and the second fastening protrusion 220 is flanked by the two guide protrusions 230. The guide depression 130 is also provided in two and the second fastening portion 120 is flanked by the two guide depressions 130. A first vent portion 240 through which air communicates is formed in the guide protrusion 230 and a second vent portion 140 through which air communicates is formed in the guide depression 130. External air can flow into the helmet body 10 through the first vent portion 240 of the guide protrusion 230 and the second vent portion 140 of the guide depression 130 in this order.

A third vent portion 150 through which air communicates is formed between the first fastening portion 110 and the second fastening portion 120 of the chin guard 100 and a fourth vent portion 250 through which air communicates is formed between the first fastening protrusion 210 and the second fastening protrusion 220 of the vent body 200. External air can flow into the helmet body 10 through the fourth vent portion 250 of the vent body 200 and the third vent portion 150 of the chin guard 100 in this order.

Figure 9:
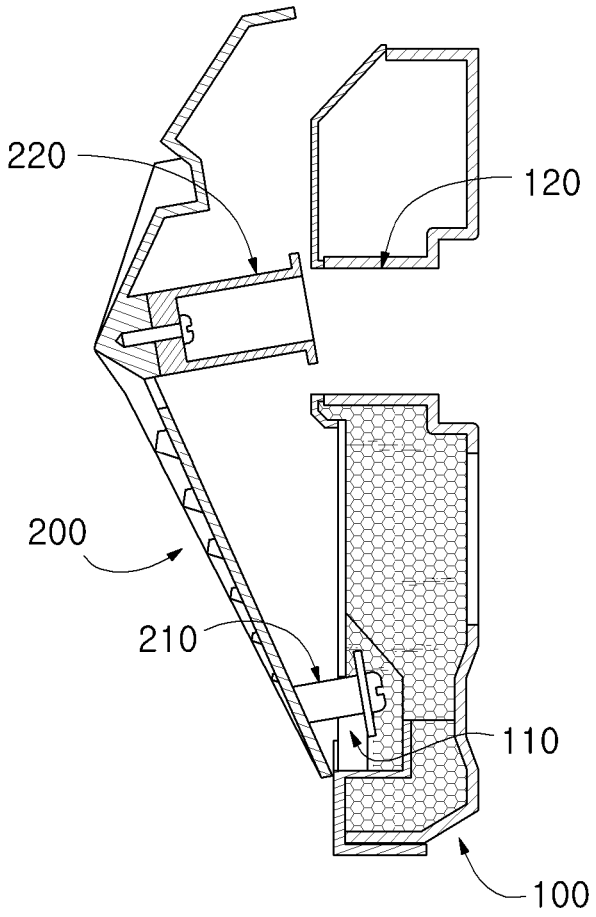
FIGS. 9 to 11 are cross-sectional views illustrating a process in which a vent body is coupled/decoupled to/from a chin guard in a helmet including mouth vents according to one embodiment of the present invention.
Figure 10:
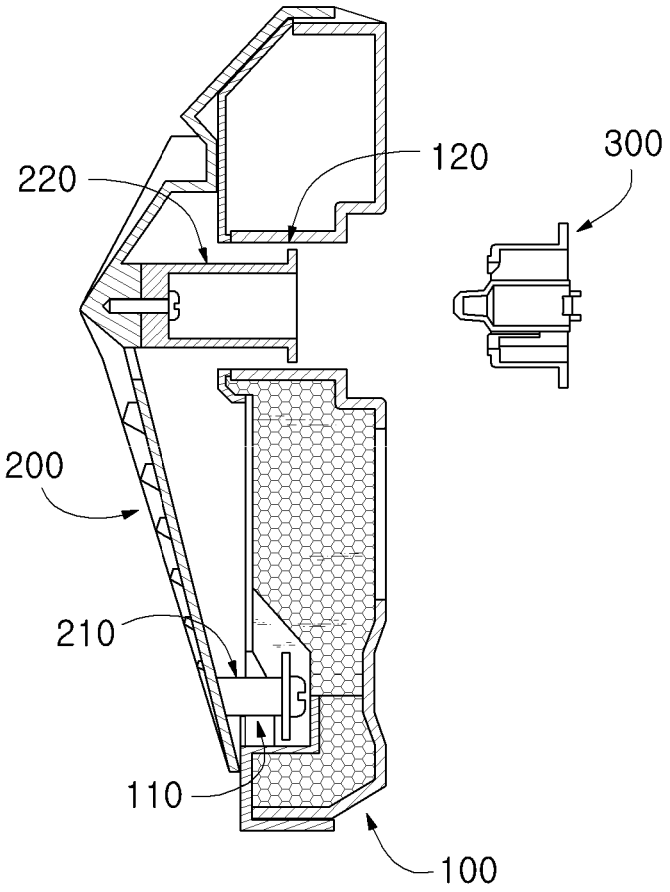
Figure 11:
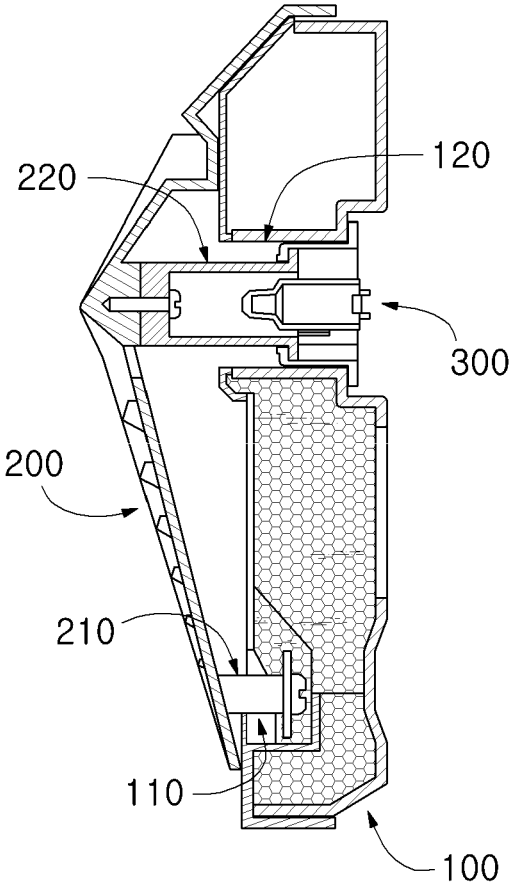

In the helmet, the vent body 200 can be easily coupled/decoupled to/from the chin guard 100. Specifically, the vent body 200 can be coupled to the chin guard 100 by the following procedure by fixedly inserting the first fastening protrusion 210 of the vent body 200 into the first fastening portion 110 of the chin guard 100 (see FIG. 9), penetrating the second fastening protrusion 220 of the vent body 200 through the second fastening portion 120 of the chin guard 100 (see FIG. 10), and coupling the fixing means 300 with the second fastening protrusion 220 of the vent body 200. The vent body 200 can be decoupled from the chin guard 100 by separating the fixing means 300 from the second fastening protrusion 220 of the vent body 200 (see FIG. 10) and simultaneously separating the second fastening protrusion 220 of the vent body 200 from the second fastening portion 120 of the chin guard 100 and the first fastening protrusion 210 of the vent body 200 from the first fastening portion 110 of the chin guard 100 (see FIG. 9).

As described above, the helmet is constructed such that the vent body 200 can be easily fixed to or separated from the chin guard 100. This construction facilitates the removal of accumulated foreign materials such as mud and dust from the vent body 200 or the chin guard 100.

The present invention has been described in detail with reference to its specific embodiments. These embodiments are provided for illustrative purposes and are not intended to limit the invention. Those skilled in the art will appreciate that various modifications and improvements are possible, without departing from the scope and spirit of the invention.

Simple modifications and changes of the present invention belong to the scope of the present invention, and the specific scope of the present invention will be clearly defined by the appended claims.

[Explanation of reference numerals]

| | |
|---|---|
| 10: Helmet body | 20: Pad |
| 30: Opening | 100: Chin guard |
| 110: First fastening portion | 111: Wall |
| 112: Fastening recess | 120: Second fastening portion |
| 121: Fastening hole | 130: Guide depression |
| 140: Second vent portion | 150: Third vent portion |
| 200: Vent body | 210: First fastening protrusion |
| 215: Latching means | 220: Second fastening protrusion |
| 223: Fastening body | 225: First fixing projection |
| 227: First stepped portion | 229: Empty space |
| 230: Guide protrusion | 235: End projection |
| 240: First vent portion | 250: Fourth vent portion |
| 300: Fixing means | 310: Fixing body |
| 320: Extension | 330: Second fixing projection |
| 333: Inclined face | 335: Second stepped portion |
| 337: Stopper | 340: Guide projection |
| 343: First projection portion | 345: Second projection portion |
| 350: First connection portion | 360: Second connection portion |
| 370: Manipulation portion | |

INDUSTRIAL APPLICABILITY

In the helmet of the present invention, the vent body can be easily fixed to or separated from the chin guard using the fixing means.

The invention claimed is:

1. A helmet comprising mouth vents, comprising: a chin guard having a first fastening portion and a second fastening portion; a vent body having a first fastening protrusion protruding toward the chin guard configured to be inserted into and fixed to the first fastening portion and a second fastening protrusion protruding toward the chin guard configured to be inserted into and penetrate the second fastening portion; and fixing means detachably coupled with the second fastening protrusion penetrating the second fastening portion to fix the second fastening protrusion to the second fastening portion, wherein the vent body further comprises at least one guide protrusion protruding toward the chin guard; a guide depression depressed corresponding to the guide protrusion is formed in the chin guard; and when the second fastening protrusion is inserted into the second fastening portion, the guide protrusion guides the second fastening protrusion toward the second fastening portion while moving in contact with the guide depression.

2. The helmet according to claim 1, wherein the first fastening portion is an upwardly open fastening recess penetrating into a wall having a predetermined thickness along the thickness direction and having a predetermined area, the first fastening protrusion is introduced into the open upper side of the fastening recess, and latching means is disposed with a larger area than the predetermined area at one end of the first fastening protrusion and is latched to the fastening recess.

3. The helmet according to claim 2, wherein the latching means is a washer coupled with the first fastening protrusion.

4. The helmet according to claim 1, wherein the second fastening portion is a fastening hole penetrating the chin guard; the second fastening protrusion is inserted into the fastening hole; and when the fixing means is coupled with the second fastening protrusion inserted into the fastening hole, at least a portion of the fixing means is latched to the fastening hole such that the second fastening protrusion is fixed to the second fastening portion.

5. The helmet according to claim 4, wherein the fixing means comprises a fixing body inserted into the fastening hole and an extension extending from the fixing body in a direction away from the center of the cross section of the fixing body and latched to the fastening hole.

6. The helmet according to claim 4, wherein the second fastening protrusion comprises a fastening body extending from the vent body configured to be inserted into the fastening hole and a first fixing projection protruding in one direction from the fastening body; the fixing means comprises a tubular fixing body into which the fastening body is insertable and a second fixing projection protruding in the other direction from the fixing body; and when the fixing body rotates after insertion of the fastening body into the fixing body, one surface of the first fixing projection comes into contact with one surface of the second fixing projection such that the fixing means is coupled with the second fastening protrusion.

7. The helmet according to claim 6, wherein the first fixing projection is provided in plurality and the first fixing projections are spaced apart from each other; the second fixing projection is provided in plurality and the second fixing projections are spaced apart from each other; and when the fastening body is inserted into the fixing body, each of the first fixing projections passes between the adjacent second fixing projections spaced apart from each other and each of the second fixing projections passes between the adjacent first fixing projections spaced apart from each other.

8. The helmet according to claim 6, wherein the fixing body is configured to rotates after insertion of the fastening body thereinto, leading one side of the first fixing projection to come into contact with one side of the second fixing projection and one surface of the first fixing projection to come into contact with one surface of the second fixing projection, wherein an inclined face is formed on at least one of the one side of the first fixing projection and the one side of the second fixing projection.

9. The helmet according to claim 6, wherein a first stepped portion protruding toward one surface of the second fixing projection is formed on one surface of the first fixing projection and a second stepped portion protruding toward one surface of the first fixing projection is formed on one surface of the second fixing projection.

10. The helmet according to claim 6, wherein when the fixing body rotates after insertion of the fastening body into the fixing body, one side of the first fixing projection comes into contact with one side of the second fixing projection and, thereafter, one surface of the first fixing projection comes into contact with one surface of the second fixing projection; and a stopper is formed at the other side of the second fixing projection to latch one side of the first fixing body.

11. The helmet according to claim 6, wherein the fastening body has an empty space formed at the center thereof, and the fixing means further comprises a guide projection formed at the center of the tubular fixing body, extending in a direction corresponding to the lengthwise direction of the fixing body, and inserted into the central empty space of the fastening body.

12. The helmet according to claim 6, wherein a manipulation portion is formed at one end of the fixing body farther away from the vent body and is manipulated to rotate the fixing body by a wearer.

13. The helmet according to claim 1, wherein the guide protrusion is provided in two and the second fastening protrusion is flanked by the two guide protrusions; and the guide depression is provided in two and the second fastening portion is flanked by the two guide depressions.

14. The helmet according to claim 1, wherein a first vent portion through which air communicates is formed in the guide protrusion and a second vent portion through which air communicates is formed in the guide depression.

15. The helmet according to claim 1, wherein a third vent portion through which air communicates is formed between the first fastening portion and the second fastening portion of the chin guard and a fourth vent portion through which air communicates is formed between the first fastening protrusion and the second fastening protrusion of the vent body.

* * * * *